US011427396B2

(12) United States Patent
Noel

(10) Patent No.: US 11,427,396 B2
(45) Date of Patent: Aug. 30, 2022

(54) SYSTEM, METHOD, AND DEVICE FOR FOILING HAIR

(71) Applicant: Kessie Emmaline Noel, Tulsa, OK (US)

(72) Inventor: Kessie Emmaline Noel, Tulsa, OK (US)

( * ) Notice: Subject to any disclaimer, the term of this patent is extended or adjusted under 35 U.S.C. 154(b) by 149 days.

(21) Appl. No.: 16/700,520

(22) Filed: Dec. 2, 2019

(65) Prior Publication Data

US 2020/0172322 A1 Jun. 4, 2020

Related U.S. Application Data

(60) Provisional application No. 62/774,587, filed on Dec. 3, 2018.

(51) Int. Cl.
*B65D 83/08* (2006.01)
*B65H 35/00* (2006.01)
*A45D 19/00* (2006.01)

(52) U.S. Cl.
CPC ..... *B65D 83/0841* (2013.01); *A45D 19/016* (2021.01); *B65H 35/008* (2013.01)

(58) Field of Classification Search
CPC . B65D 83/0841; A45D 19/016; B65H 35/008
See application file for complete search history.

(56) References Cited

U.S. PATENT DOCUMENTS 5,469,873 A 11/1995 Guth
5,664,590 A * 9/1997 Plateroti ..... A45D 19/018 132/270
5,816,268 A 10/1998 Awaijane
6,851,592 B1 * 2/2005 Owen ..... B65H 35/002 225/1
8,322,353 B2 * 12/2012 Russell ..... A45D 19/016 132/222
2002/0074376 A1 6/2002 Polesuk
2003/0150468 A1 8/2003 Polesuk
2004/0011842 A1 6/2004 Russell
2004/0168995 A1 9/2004 Ignoffo, Jr. et al.
2006/0169112 A1 * 8/2006 Frank ..... B65H 35/008 83/13
2008/0222894 A1 * 9/2008 Borenslein ..... B26D 5/26 30/43.92
2016/0166031 A1 * 6/2016 Callicutt ..... A45D 44/00 132/200
2017/0224080 A1 * 8/2017 Callicutt ..... A45D 44/02

FOREIGN PATENT DOCUMENTS

GB 2577031 A * 3/2020 ..... A45D 19/012

OTHER PUBLICATIONS

Korean Intellectual Property Office (KIPO); International Search Report and Written Opinion; dated May 20, 2020.

* cited by examiner

*Primary Examiner* — Omar Flores Sanchez
(74) *Attorney, Agent, or Firm* — Head, Johnson, Kachigian & Wilkinson, PC

(57) ABSTRACT

A system, method, and device for foiling hair while using a technique similar to balayage. The system uses hair foils with at least one jagged edge, essentially functioning as a stencil for the balayage design technique. As such, the foil may not leave a straight demarcation when color is brushed off the ends of the foil onto the hair underneath from the previous foil layer, allowing the hair artist to employ a foiling process that is a combination of a paneled layering technique and a balayage technique.

13 Claims, 13 Drawing Sheets

SYSTEM, METHOD, AND DEVICE FOR FOILING HAIR

CROSS REFERENCE

This application is based on and claims priority to U.S. Provisional Patent Application No. 62/774,587, filed Dec. 3, 2018, which is incorporated herein in its entirety by reference.

BACKGROUND OF THE INVENTION

Field of the Invention

This invention relates generally to hair foils and hair coloring techniques, and more particularly, but not by way of limitation, to a type of foil that does not leave a straight demarcation when brushed off the ends of the foil onto the hair underneath from the previous foil layer, essentially functioning as a stencil for the balayage design technique, and a foiling process that is a combination of a paneled layering technique and a balayage technique.

Description of the Related Art

There are many techniques for coloring and highlighting hair. These include brushing on color; using a cap for highlighting; foiling; and, more recently, a technique known as balayage.

Stylists often use foils when coloring hair to allow the use of multiple colors and shades, often with the goal of adding highlights, dimension, and/or a natural effect. Typically, the stylist places a foil under a small section of hair, then paints color onto the hair atop the foil. The stylist then folds the foil up with the hair inside and moves to the next section of hair. This keeps the hair color for each section separate and neat and allows for more control over the combination and pattern of colors than brushing on color freehand. All foils currently in use are rectangular, with straight edges.

Balayage is a French word that translates to "sweeping." The balayage technique, when done properly on hair, creates a very natural blending of color from the top of the hair strand to the bottom. The balayage technique does not use foils, but rather involves brushing hair color lightly on the hair in sections. Some stylists use a clay-based bleach that forms a hardened shell and can work better than normal bleach to achieve the desired effect. This clay-based balayage bleach still does not get light enough for most clients' liking, however, and therefore the stylist often has to book out double time to double bleach and also tone.

Based on the foregoing, it is desirable to provide an improved technique that combines foiling with a balayage technique.

It is further desirable to provide foils with a jagged edge for use with the improved technique.

It is further desirable to provide a device that allows a stylist to cut such foils to a custom length.

It is further desirable to provide a system that allows a stylist to cut fully customized foils for use with a particular client.

SUMMARY OF THE INVENTION

In general, in a first aspect, the invention relates to a hair foil comprising at least one jagged edge. The jagged edge may comprise at least one jag with a depth of at least 0.25 inches. For example, the jagged edge may comprise three points, each two inches long; two points, each four inches long; five points: a first point and a fifth point, each five inches long; a second point and a fourth point, each four inches long; and a third point, two inches long, such that the five points form a V-shaped pattern; or any other desired number of points and pattern of jags.

In a second aspect, the invention relates to a foil dispenser capable of dispensing hair foils where each of the foils comprises at least one jagged edge. The jagged edge may comprise at least one jag with a depth of at least 0.25 inches.

The foil dispenser may comprise: a box with a top; a slot in the top; and a plurality of the hair foils in the box, where the foils are stacked and folded such that pulling a first foil out of the slot pulls one end of a next foil out of the slot. The foil dispenser may further comprise a second slot in the top and a plurality of straight edge hair foils in the box, where the straight edge hair foils are stacked and folded such that pulling a first straight edge hair foil out of the second slot pulls one end of a next straight edge hair foil out of the slot. Alternately, the foil dispenser may further comprise a second slot in the top and a plurality of alternate hair foils in the box, where the alternate hair foils are stacked and folded such that pulling a first alternate hair foil out of the second slot pulls one end of a next alternate hair foil out of the slot, and where the jagged edge of the alternate hair foils have a different pattern than the jagged edge of the hair foils. The foil dispenser may further comprise a third slot in the top and a plurality of straight edge hair foils in the box, where the straight edge hair foils are stacked and folded such that pulling a first straight edge hair foil out of the third slot pulls one end of a next straight edge hair foil out of the slot.

In a third aspect, the invention relates to a hair foil cutter comprising a roll of foil material and at least one blade capable of cutting the foil material into a plurality of hair foils each comprising at least one jagged edge. The jagged edge may comprise at least one jag with a depth of at least 0.25 inches. The hair foil cutter may comprise a box with at least one top edge, where: the roll of foil material is housed within the box; and the blade is attached to the top edge such that a user is capable of unrolling a length of foil material from the roll and cutting it against the blade to produce a hair foil with a jagged edge. The roll of foil material may be replaceable and the blade may be interchangeable.

The box may comprise at least one additional top edge and at least one additional blade may be attached to the at least one additional top edge. The box may be rotatable relative to the roll of foil material such that the box is capable of being rotated to align the roll with one of the blades. Each of the blades may have a different pattern such that hair foils cut with the blades have different patterns of jagged edges.

Alternately, the hair foil cutter may be electronic. The hair foil cutter may be capable of being programmed to cut hair foils in any desired quantity, each with any desired length and any desired pattern of jagged edge.

Figure 1:
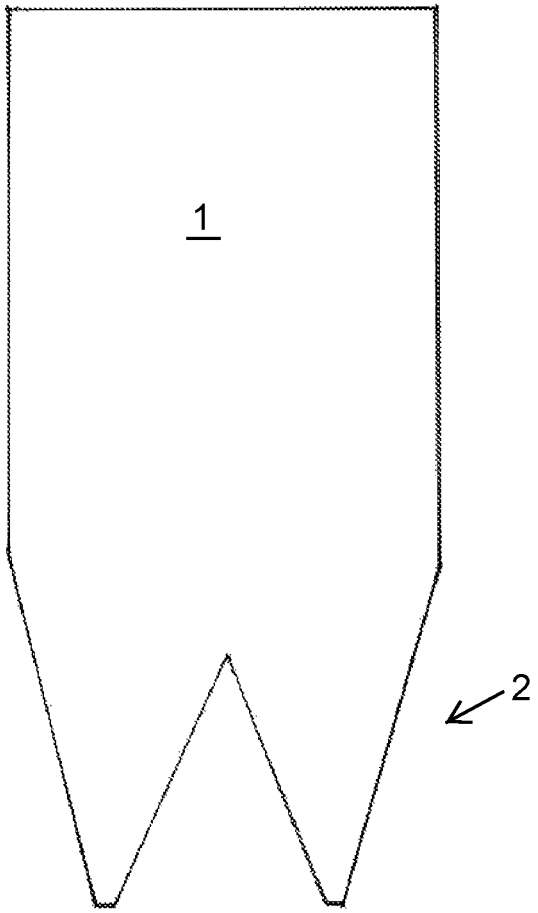
FIG. 1 is a top view of a hair foil of the present invention.
Figure 2:
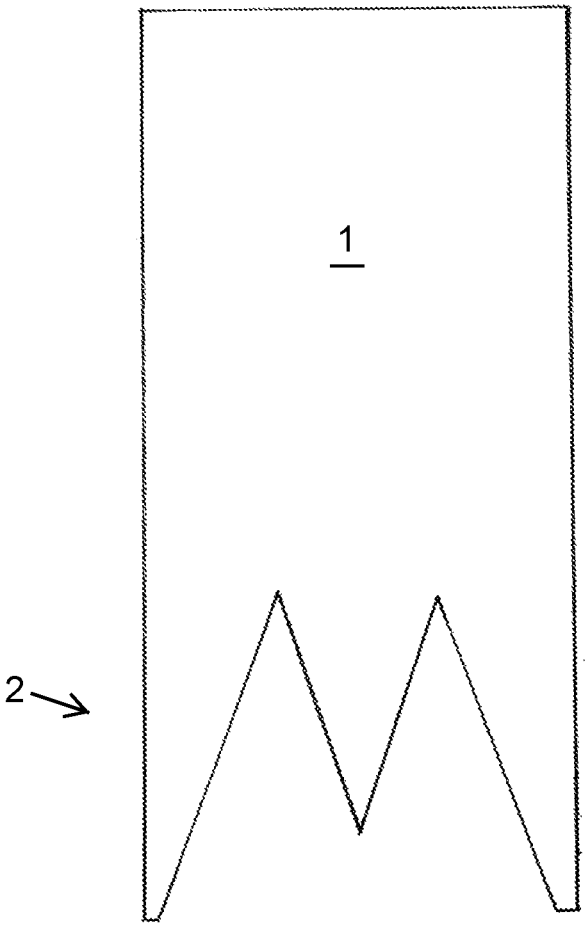
FIG. 2 is a top view of a hair foil with a second pattern of jags.
Figure 3:
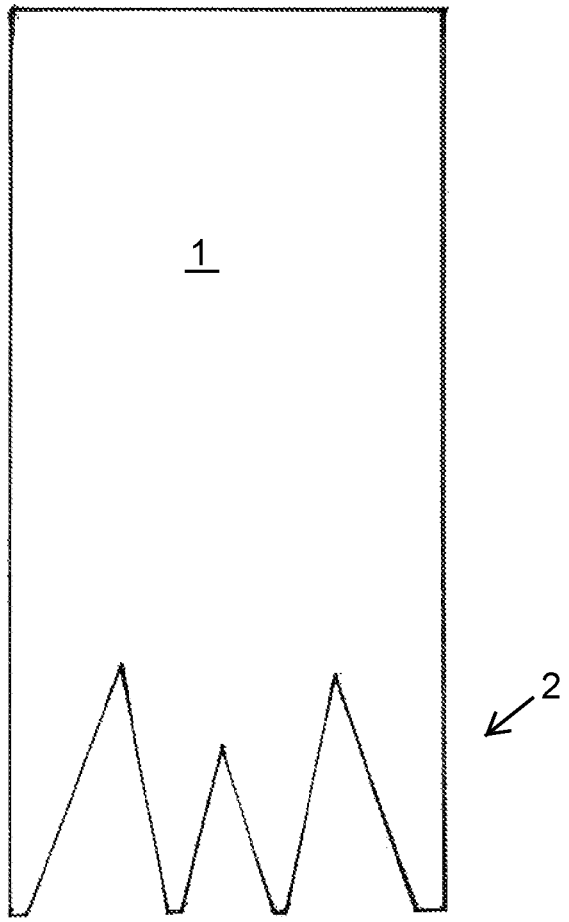
FIG. 3 is a top view of a hair foil with a third pattern of jags.
Figure 4:
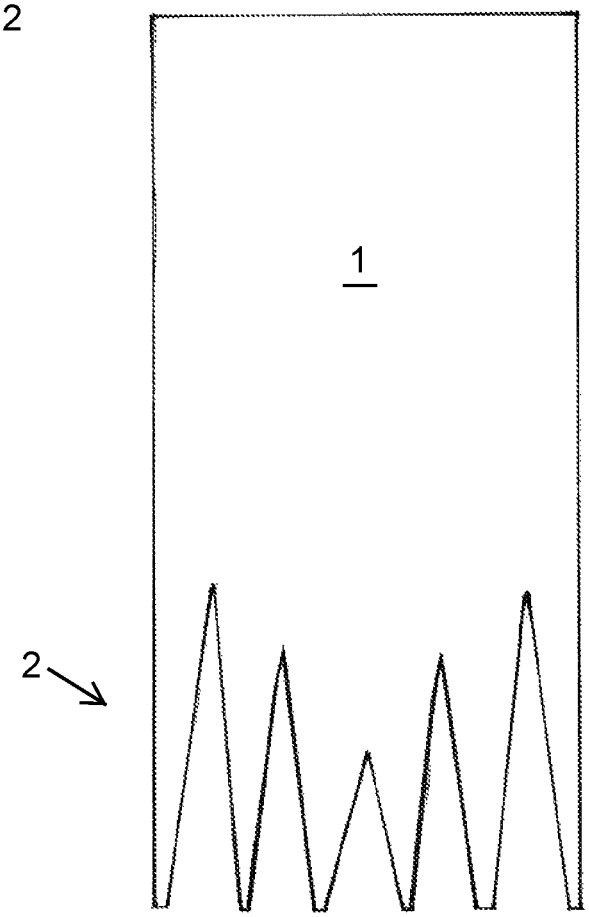
FIG. 4 is a top view of a hair foil with a fourth pattern of jags.
Figure 5:
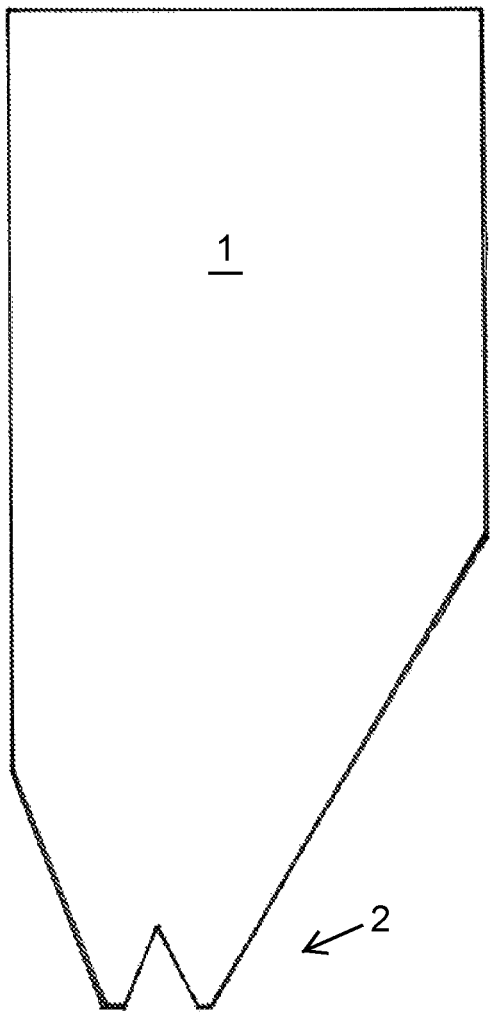
FIG. 5 is a top view of a hair foil with a fifth pattern of jags.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a system, method, and device for foiling hair. The system comprises foils 1 with at least one jagged edge 2. The edge 2 may have any desired number and pattern of jags, which may each be any desired size and shape. For example, the jagged edge 2 may have three points, each two inches long; the jagged edge 2 may have two points, each four inches long; or the jagged edge 2 may have three or more points of varying lengths. For example, the first and last points may be five inches long, the second and fourth points may be four inches long, and the middle point may be two inches long, forming a V-shaped pattern of jags. Alternately, the variable lengths may alternate, forming a W-shaped pattern of jags. Alternately, the variable lengths of points may form a check mark-shaped pattern of jags, with the shortest point offset from the center. These examples are not limiting, but merely illustrate possible options for the jagged edge 2. Non-limiting examples are shown in FIGS. 1 through 5.

The jagged edge 2 may not be merely serrated, as formed by a typically serrated cutter on an ordinary foil dispenser. Ordinary foil dispensers may have a serrated cutter, similar to that on a box of plastic wrap or aluminum foil for food storage. The serrated cutter typically has many tiny teeth, resulting in a cut edge that is serrated, with many tiny jags of very shallow depth. This type of jagged edge is not the type described as the jagged edge 2 of the present invention. The typical tiny jags are of insufficient size to produce the results described herein of the present invention. As such, the jagged edge 2 may have at least one point that is longitudinally offset from at least one other point on the jagged edge 2 by at least 0.25 inch. Additionally or alternately, the longitudinal offset may be at least 0.5 inch; at least 0.75 inch; at least 1 inch; at least 1.5 inch; at least 2 inches; at least 3 inches; at least 4 inches; or at least 5 inches, or any other desired longitudinal offset. The jagged edge 2 may have any number of additional points that are longitudinally offset any distance from any other point on the jagged edge 2, as desired.

While the jagged edge 2 is shown with jags forming sharp points with inverted sharp points between, the jags may additionally or alternately be any other desired shape. For example, the jags may be rounded or may be a combination of rounded and pointed, forming any desired pattern, such as scallops, waves, zig zags, etc.

The foils 1 may each be generally rectangular and may be made of aluminum, plastic, vinyl, other metal, or any other desired material. The foils 1 may be thin and flexible and easily folded.

Figure 6:
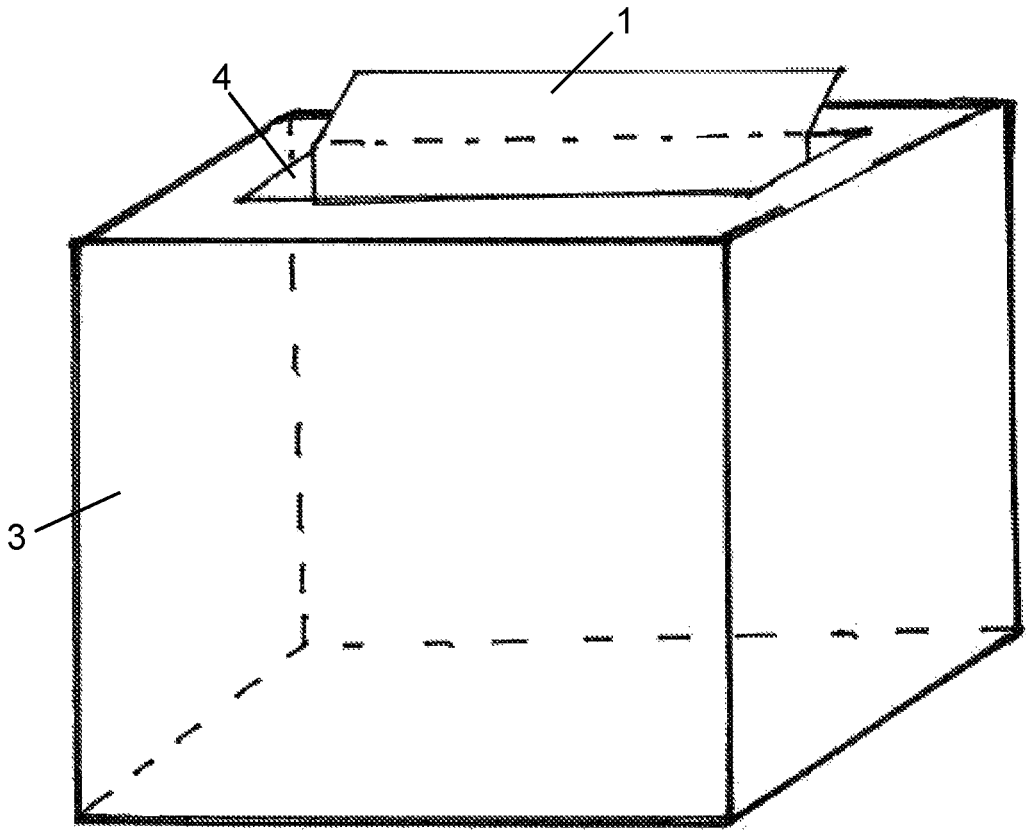
FIG. 6 is a perspective view of a hair foil dispenser.
Figure 7:
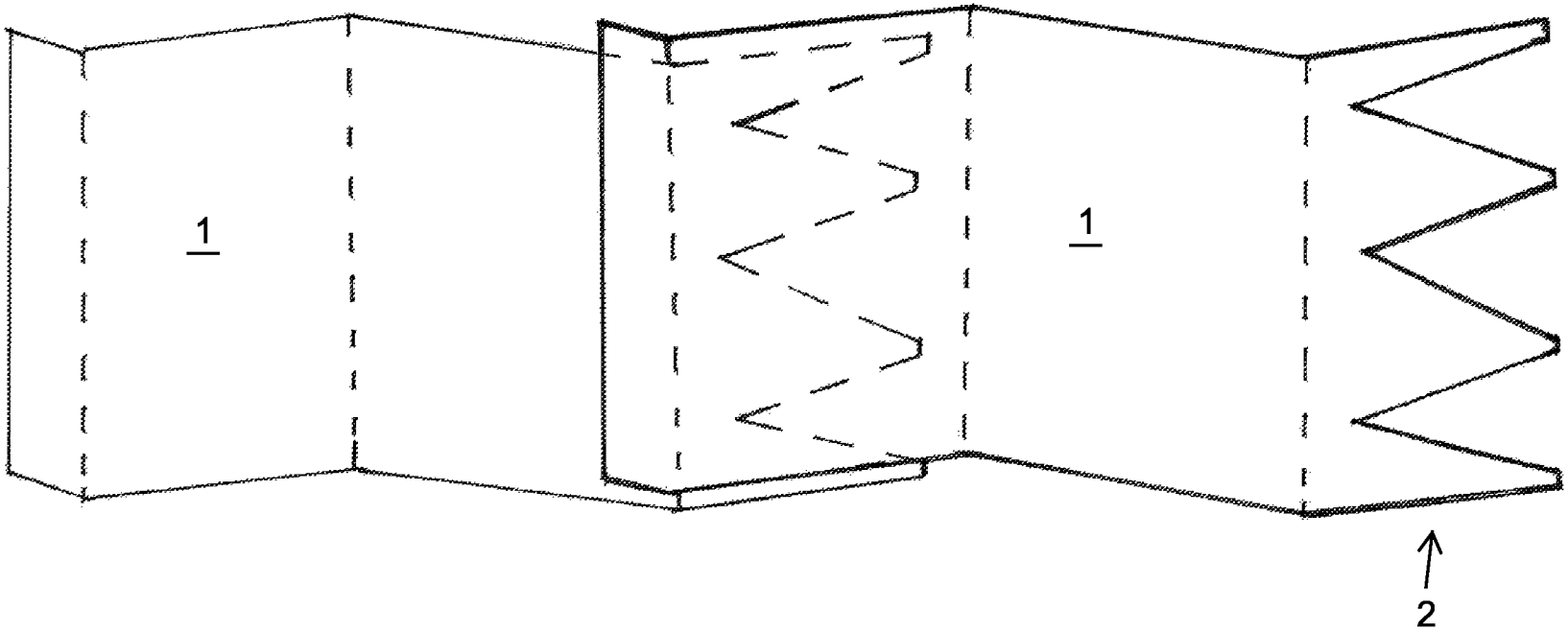
FIG. 7 is a top view of a series of hair foils folded for use in a pop-up hair foil dispenser, shown unfolded.
Figure 8:
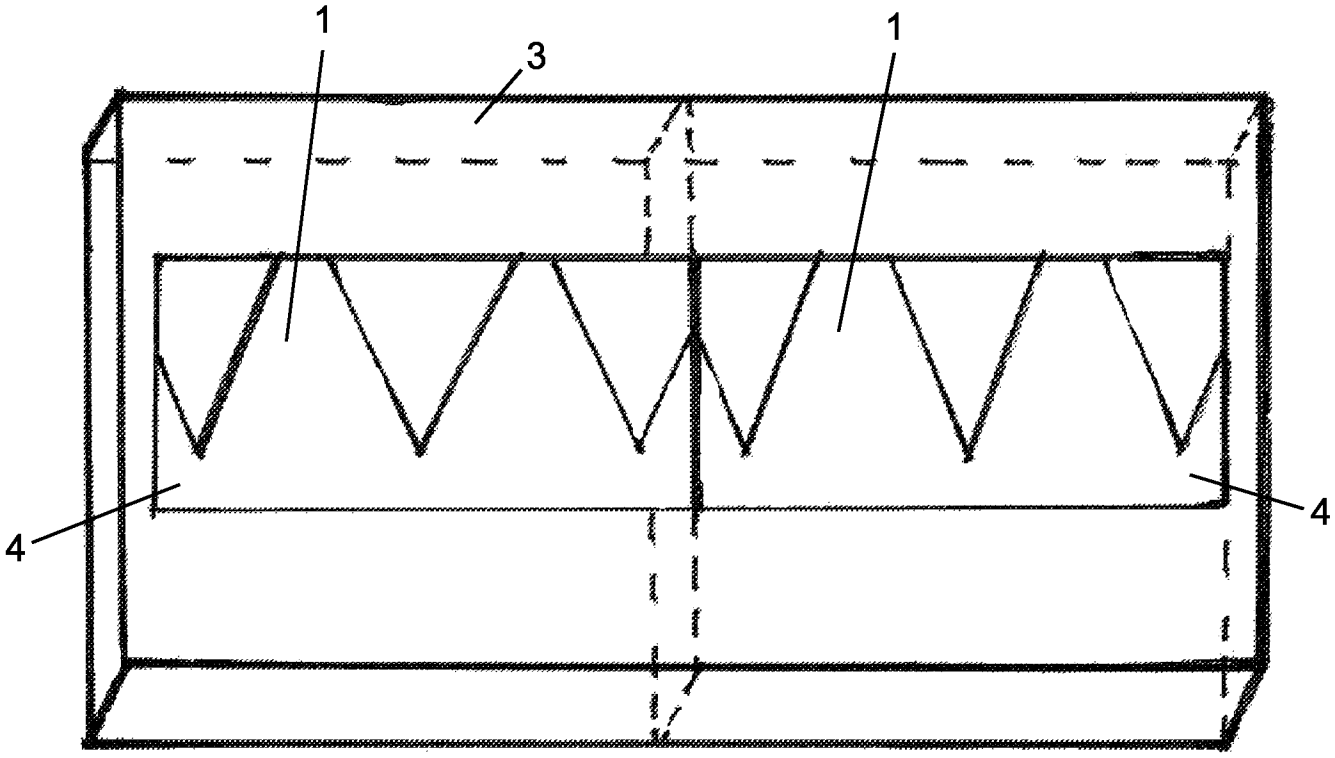
FIG. 8 is a top view of a double hair foil dispenser.

The foils 1 may be in a dispenser 3, which may hold stacks of foils 1 in any desired quantity. The dispenser 3 may be a pop-up dispenser 3, as shown in FIG. 6, and may have a slot 4 in its top, and an edge of the top foil 1 contained therein may extend out of the slot 4. The foils 1 contained in the pop-up dispenser 3 may be pre-cut such that the foils 1 are disconnected from each other and may be folded in such a way that removing the top foil 1 pulls the edge of the next foil 1 out of the slot 4, as is typical of pop-up dispensers 3, as shown in FIG. 7. The pop-up dispenser 3 may contain only one stack of foils 1 of the present invention. Alternately, the pop-up dispenser 3 may contain two or more separate stacks of foils 1 with separate slots 4, such that the dispenser 3 is capable of dispensing from each of the separate stacks simultaneously, as shown in FIG. 8. The separate stacks of foils 1 may include one stack of foils 1 with a jagged edge 2 and one stack of customary foils with a straight edge; one stack of foils 1 with one style of jagged edge 2 and a second stack of foils 1 with a different style of jagged edge 2; two stack so of foils 1 with different jagged edges 2 and one stack of customary foils with a straight edge; or any desired number of foils 1 with jagged edges 2 and any desired number of customary foils with straight edges. The separate stacks may have the same length and/or width as each other or different lengths and/or widths, as desired.

For example, the dispenser 3 may dispense foils 1 that are 6 inches in length with jags that are 1 inch in depth, which may accommodate hair that is approximately 8 to 10 inches in length from the scalp. In a second example, the dispenser 3 may dispense foils 1 that are 10 inches in length with jags that are 2 inches in depth, which may accommodate hair that is 10 to 14 inches in length from the scalp. In a third example, the dispenser 3 may dispense foils 1 that are 12 inches in length with jags that are 3 inches in depth, which may accommodate hair that is 14 to 20 inches in length. In a fourth example, the dispenser 3 may be a double pop-up dispenser 3 that has the 6-inch foils 1 on one side and 10-inch foils 1 on the other, which may accommodate hair that is 8 to 14 inches in length. This dispenser may also accommodate layered hair that is longer at the nape/bottom and short at the crown. In a fifth example, the dispenser 3 may be a double pop-up dispenser 3 that has foils 1 that are 10 inches and 12 inches, accommodating layered hair that is 14 to 20 inches or longer in overall length.

Alternately, the foils 1 may be produced by the hair artist on demand using a foil cutter 5, which may be manual or electronic.

Figure 9:
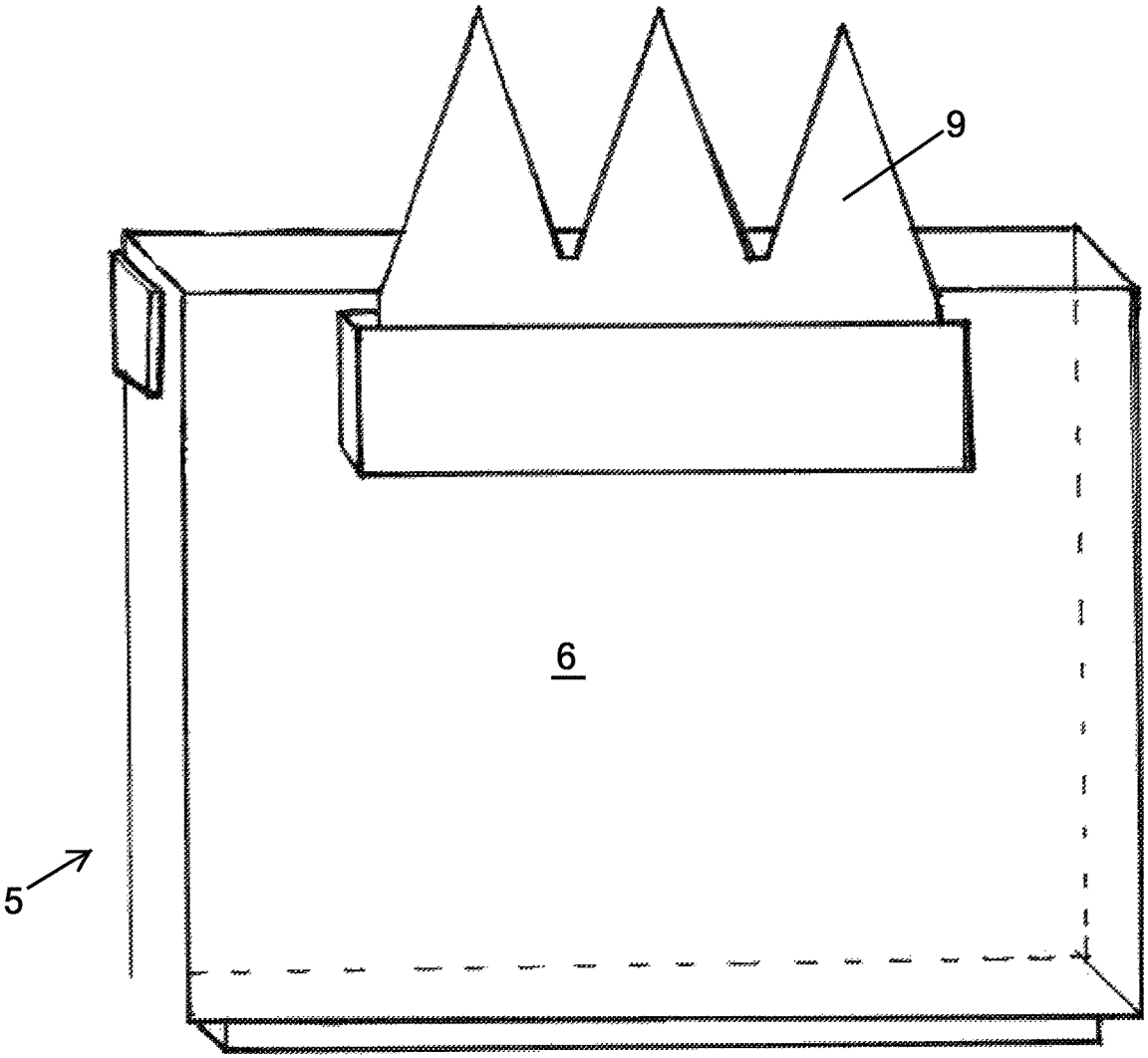
FIG. 9 is a perspective view of a manual hair foil cutter.
Figure 10:
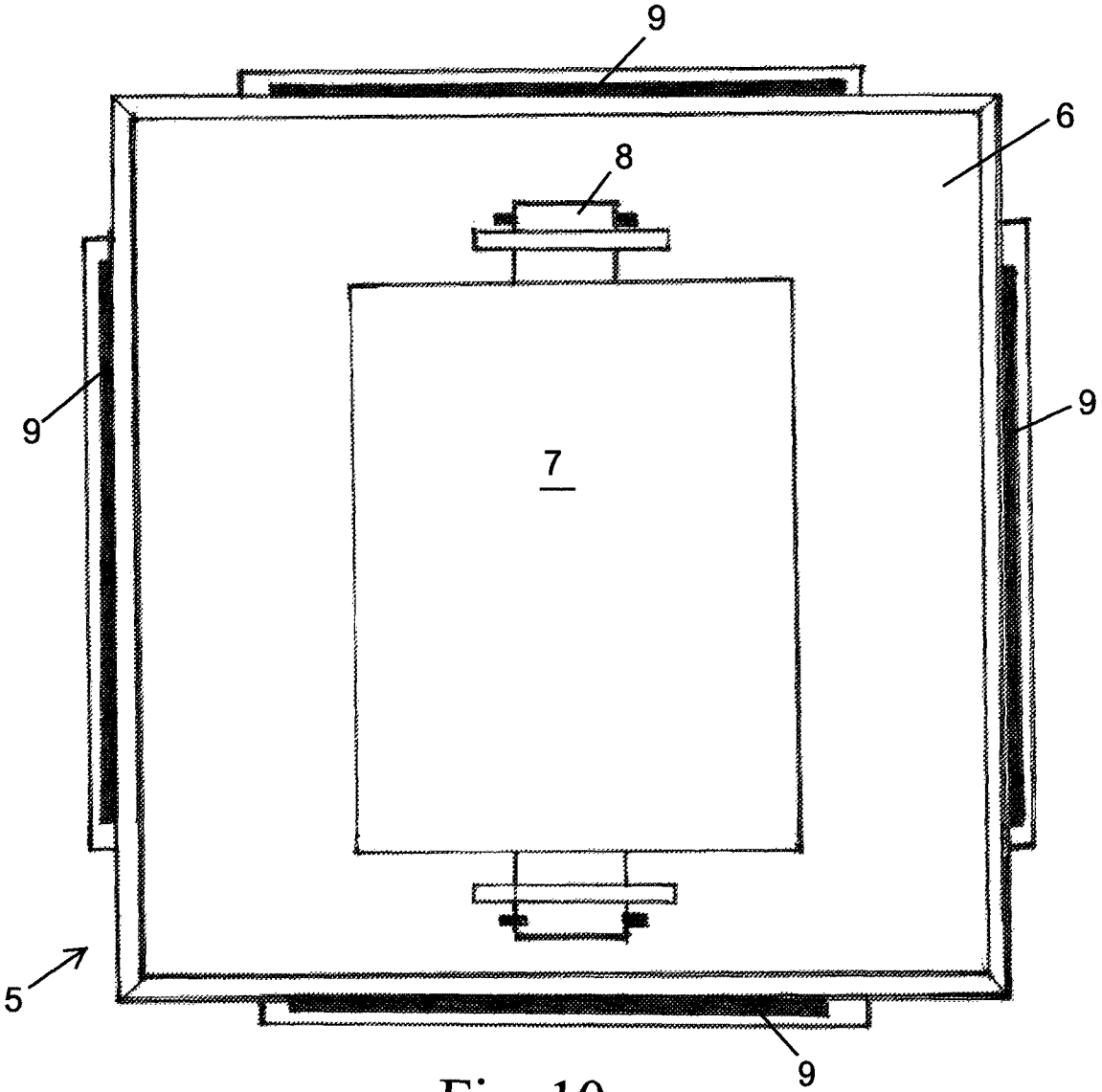
FIG. 10 is a top view of the manual hair foil cutter.

The foil cutter 5 may be manual, as shown in FIGS. 9 and 10, comprising a box 6 housing a roll 7 of foil material of a desired width on a holder 8. The roll 7 may be replaceable. The box 6 may have at least one blade 9 along at least one top edge, allowing the user to cut a foil 1 at a desired length by pulling the foil material to the desired length and pressing the foil material against the blade 9 to cut it, similar to a box of plastic wrap or aluminum foil for food storage. The distinction is that the blade 9 may be shaped appropriately to produce the jagged edge 2 of the present invention, with jags of greater depth than a merely serrated edge, as described above. The blade 9 may be interchangeable, allowing the hair artist to select the appropriate jag pattern and depth for a particular client.

The box 6 may have four top edges, and each top edge may have a different blade 9. Either the holder 8 and roll 7 housed within the box 6 or the box 6 itself may be mounted on a swivel, allowing the hair artist to rotate either the roll 7 to face a desired blade 9 or the box 6 to align the desired blade 9 with the roll 7. The swivel may be capable of being locked into place for use. Thus, the hair artist may be able to select up to four different styles of blade 9 for use with a particular client and may thus be able to produce foils 1 with up to four different jagged edge 2 patterns and/or depths on demand by merely rotating the box 6 or roll 7 to the desired blade 9, pulling the foil material to a desired length, and cutting the foil 1.

Figure 11:
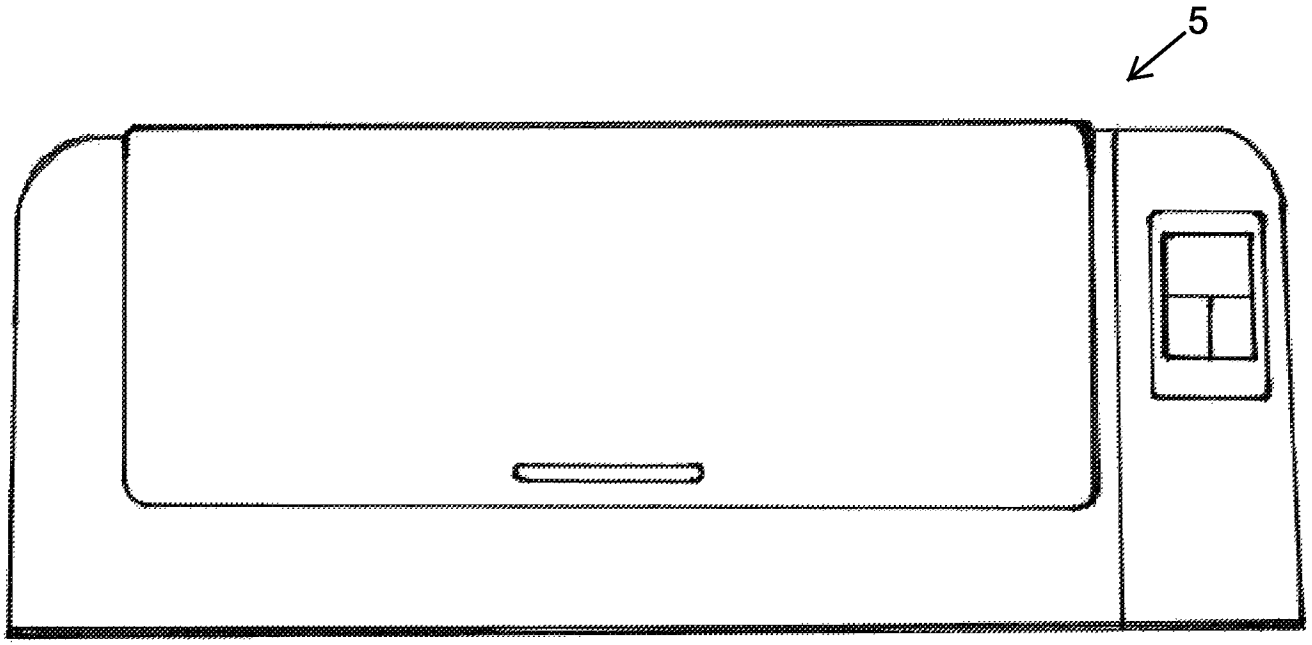
FIG. 11 is front view of an electronic hair foil cutter.
Figure 12:
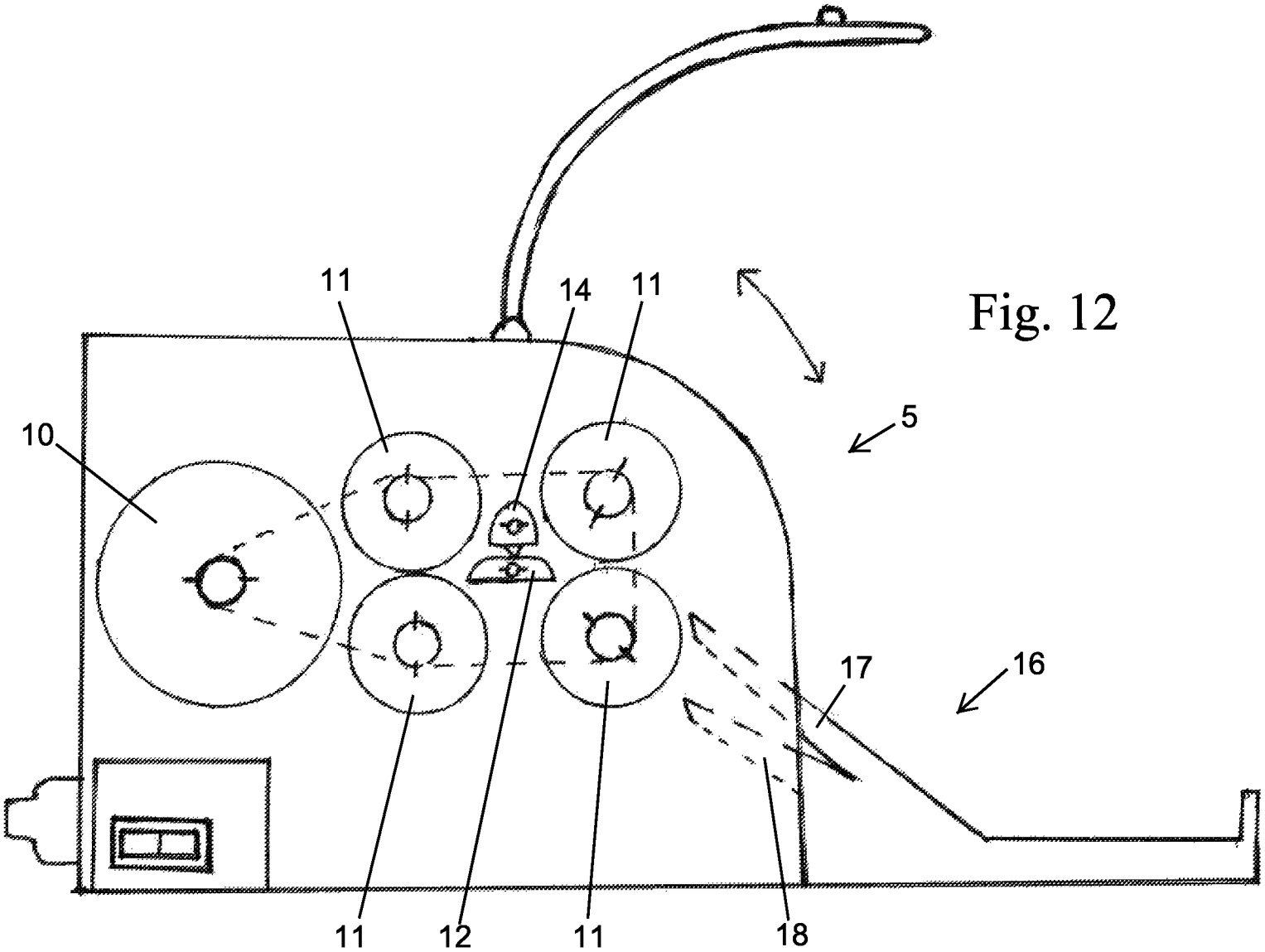
FIG. 12 is a side cut away view of the electronic hair foil cutter.
Figure 13:
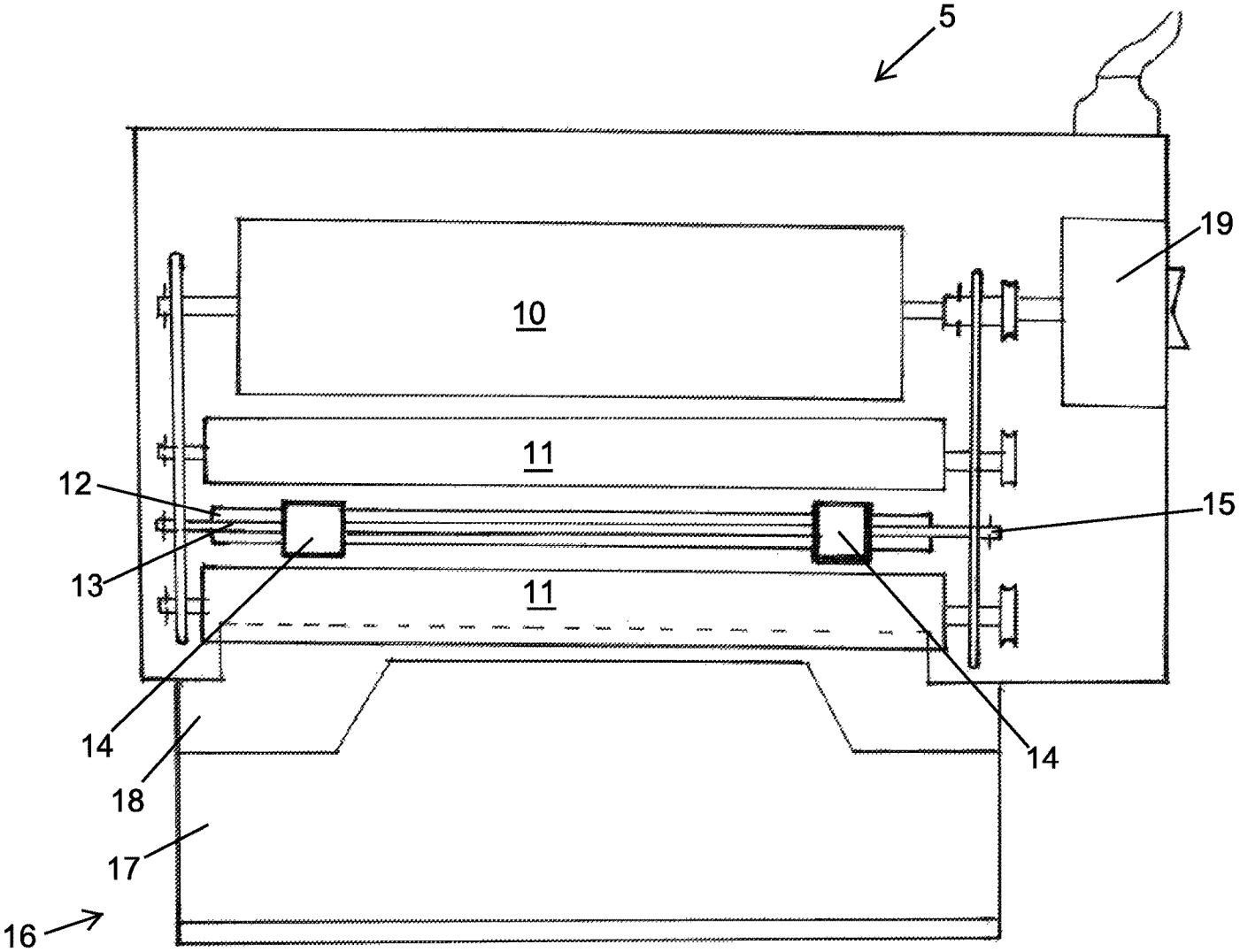
FIG. 13 is a top cut away view of the electronic hair foil cutter.
Figure 14:
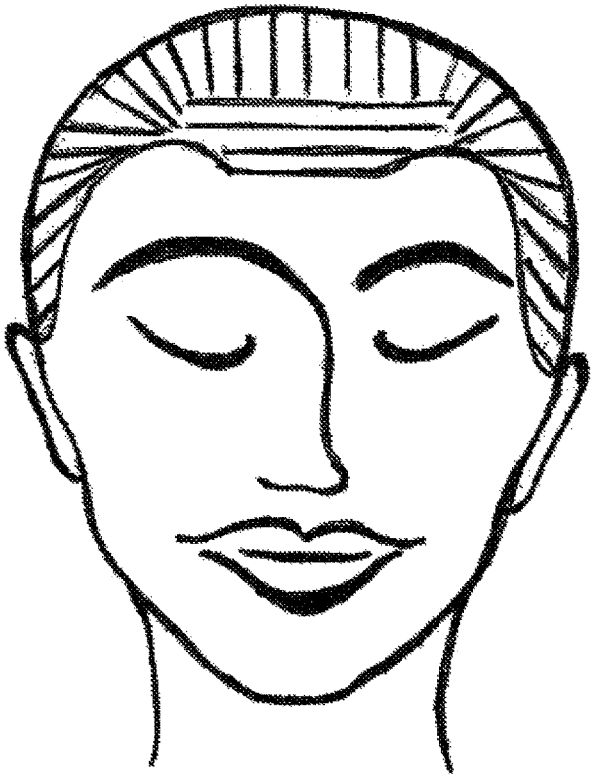
FIGS. 14 through 18 are front, right side, back, top, and left side views of a head, illustrating the over, sliced, under technique described herein.
Figure 15:
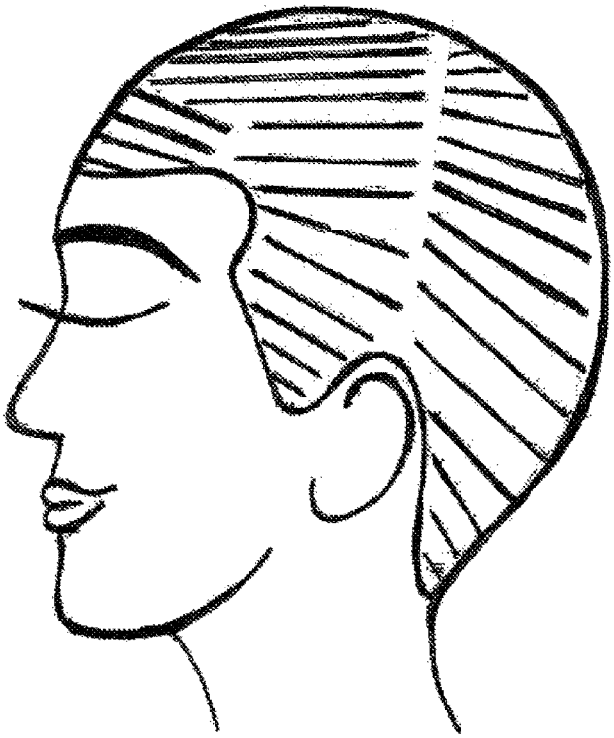
Figure 16:
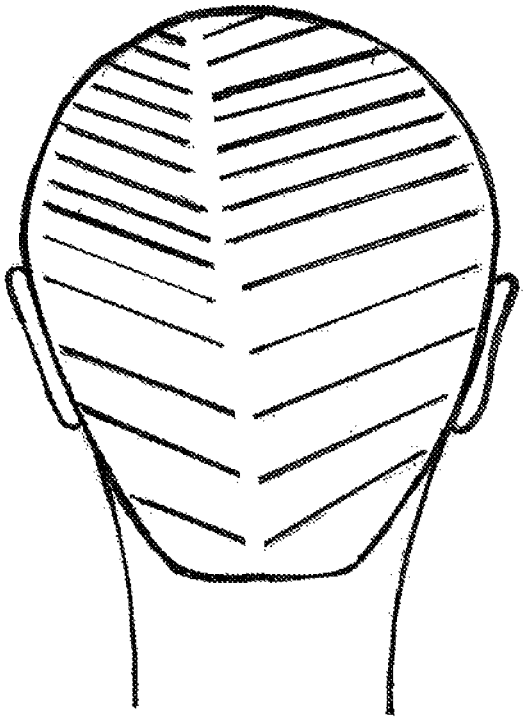
Figure 17:
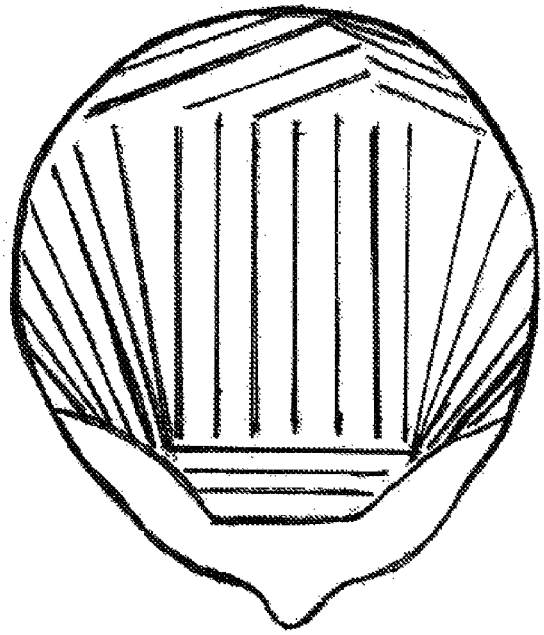
Figure 18:
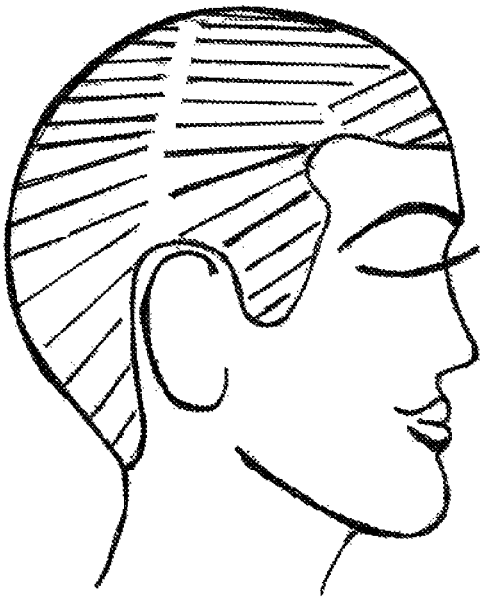

Alternately, the foil cutter 5 may be a personal sized programmable electronic foil cutter 5, as shown in FIGS. 11 through 13. The electronic foil cutter 5 may be capable of cutting foils 1 to different lengths, depending on hair length and desired look. This electric foil cutter 5 may have a foil roll 10, two or more feed rollers 11, and a double pane cutting glass 12 with a cutting slit 13 across the top glass layer. Two digital Bluetooth-programmable cutters 14 may be attached to a rail 15 and may be capable of cutting the jag depths and length of the custom foils 1. The foil cutter 5 may also have a foil tray 16 that may not only catch the completed foils 1, but also waste. The tray 16 may have two levels. One level 17 may be in the middle and closest to the glass 12 in order to catch the foil 1. A waste level tray 18 may go under the glass 12 under both open ends of the cut foil 1 to catch waste as it slides under the finished foil tray 17 into the waste bin. The cutter 5 may be powered by a motor 19.

During use, the hair artist may use the foils 1 with a modified balayage technique to produce natural results. In order to create depth and blending, the artist may first weave from the bottom of a larger sliced section, approximately a quarter to half of an inch in thickness, and apply a darker color than a chosen bleach or other very light highlight color. This darker color may be lighter or darker than the natural/base hair color. The artist may then weave or thinly slice from the top of the same larger sliced section to create an intertwined weave of both colors through the one larger section of hair. This is the over, sliced, under ("OSU") foiling technique, as shown in FIGS. 14 through 18. The artist may lay down a foil 1 between every layer of hair color and sliced/weaved hair. At this point, if the desired base color of the hair, or in other words the overall hair color on the entire head, is to be left natural or as is, the artist may use a conditioner to put on the base colored hair between the OSU foiling technique in order for the foil 1 to stick and stay put. The artist may thus avoid folding each foil 1, as is traditionally required. If the desired base color of the hair is to be changed, the color may be applied instead of conditioner, again without the requirement of folding each foil 1.

If the artist wants to drop just the base, or in other words the root on the scalp, of the overall base color, the artist may then balayage the desired depth of color toward the ends of the hair with either a brush or comb, blending the darker color into the lighter ends of the hair. The artist may balayage a second color that is two shades lighter into the darker applied root color onto the target strand and then comb through from the top to the ends, ensuring the blending of the shades. This second color may be used when the desired root color is more than five levels darker than the desired end-of-the-hair color. The foils 1 with jagged edges 2 may not leave a straight demarcation line when brushed off the ends of the foil 1 onto the underneath hair from the previous foil layer, as would occur with standard foils.

All hair foils on the market today are cut straight on both ends. The jagged edge 2 of the foils 1 of the present invention, on the other hand, may create a blending of the hair color as it is brushed off the foils 1 to the ends of the hair. As the artist sweeps the bleach/color onto and into the target hair strands to the ends of the foils 1, the artist may sweep the bleach/color off of the ends of the foils 1 onto the hair that is hanging out of the ends of the foil 1 under the current target layer. While most hair artists today are not focusing on the hair already foiled underneath the current target section, working not only with the target section but also with the underneath sections of hair sticking out of the foils 1 may allow the artist to create an overall well-executed, natural balayage look in just one foiling process. The foils 1 and technique of the present invention may allow the artist to work with the entire head of hair. Whether it is the base color layer or the last bleached layer, the artist may be able to add more bleach/color with every new foil layer to all the ends. Each layer of bleach that the artist uses while layering up the head from the perimeter (bottom hairline) to the crown (top of the head) may apply another layer of saturation to the ends of the overall hair. This may keep the bleach wet and processing, so that the end color is much lighter than a traditional balayage technique and may also create a seamless overall, well-executed, natural balayage-looking hair design due to the jagged edge 2 of the foils 1.

When each foiled section is complete, the artist may simply cover the entire section with foil and fold it together as one unit. This unit of foils 1 may make it much easier to check the color as it is processed and may be much easier and quicker to pull off of the hair when ready to rinse out. There may be no need to use any new, expensive, clay-based bleach because foil conducts heat better than even the hardened shell of the clay bleach.

Oftentimes, when using the balayage technique without foils, the hair has to be double bleached/processed and almost always toned to take away the unwanted yellow/warm tones in order to get the lightness and tone that is desired. With the process and foils 1 of the present invention, a toner is generally not needed, because the foiling process may lift to a much lighter tone than any brushed or painted-on bleach. This may be due to the heat conduction of the foils 1 and bleach/color between the foils 1, thereby cutting the overall time of the hair service significantly.

Whereas, the devices and methods have been described in relation to the drawings and claims, it should be understood that other and further modifications, apart from those shown or suggested herein, may be made within the spirit and scope of this invention.

What is claimed is:

1. A foil dispenser capable of dispensing hair foils where the foil dispenser comprises:

a box with a top;

a slot in the top; and a plurality of the hair foils in the box, where each of the hair foils comprises at least one jagged edge and the foils are stacked and folded such that pulling a first foil out of the slot pulls one end of a next foil out of the slot;

the foil dispenser further comprising:

a second slot in the top; and a plurality of straight edge hair foils in the box, where the straight edge hair foils are stacked and folded such that pulling a first straight edge hair foil out of the second slot pulls one end of a next straight edge hair foil out of the slot.

2. The foil dispenser of claim 1 where the jagged edge comprises at least one jag with a depth of at least 0.25 inches.

3. A foil dispenser capable of dispensing hair foils where the foil dispenser comprises:

a box with a top;

a slot in the top; and a plurality of the hair foils in the box, where each of the hair foils comprises at least one jagged edge and the foils are stacked and folded such that pulling a first foil out of the slot pulls one end of a next foil out of the slot;

the foil dispenser further comprising:

a second slot in the top; and a plurality of alternate hair foils in the box, where the alternate hair foils are stacked and folded such that pulling a first alternate hair foil out of the second slot pulls one end of a next alternate hair foil out of the slot, and where the jagged edge of the alternate hair foils have a different pattern than the jagged edge of the hair foils.

4. The foil dispenser of claim 3 further comprising:

a third slot in the top; and a plurality of straight edge hair foils in the box, where the straight edge hair foils are stacked and folded such that pulling a first straight edge hair foil out of the third slot pulls one end of a next straight edge hair foil out of the slot.

5. A hair foil cutter comprising:

a roll of foil material; and at least one blade capable of cutting the foil material into a plurality of hair foils each comprising at least one jagged edge.

6. The hair foil cutter of claim 5 where the jagged edge comprises at least one jag with a depth of at least 0.25 inches.

7. The hair foil cutter of claim 5 where the hair foil cutter comprises a box with at least one top edge, where:

the roll of foil material is housed within the box; and the blade is attached to the top edge such that a user is capable of unrolling a length of foil material from the roll and cutting it against the blade to produce a hair foil with a jagged edge.

8. The hair foil cutter of claim 7 where the roll of foil material is replaceable.

9. The hair foil cutter of claim 7 where the blade is interchangeable.

10. The hair foil cutter of claim 7 where:

the box comprises at least one additional top edge and at least one additional blade is attached to the at least one additional top edge; and the box is rotatable relative to the roll of foil material such that the box is capable of being rotated to align the roll with one of the blades.

11. The hair foil cutter of claim 10 where each of the blades have a different pattern such that hair foils cut with the blades have different patterns of jagged edges.

12. The hair foil cutter of claim 5 where the hair foil cutter is electronic.

13. The hair foil cutter of claim 12 where the hair foil cutter is capable of being programed to cut hair foils in any desired quantity, each with any desired length and any desired pattern of jagged or straight edge.

* * * * *